US012234049B2

(12) United States Patent
Cassoli et al.

(10) Patent No.: US 12,234,049 B2
(45) Date of Patent: Feb. 25, 2025

(54) PACKAGING MACHINE WITH DYNAMIC BUFFER AND ITS ASSEMBLY METHOD

(71) Applicant: CPS Company S.r.l., Casalecchio di Reno (IT)

(72) Inventors: Marco Cassoli, Casalecchio di Reno (IT); Nicola Giuliani, Valsamoggia (IT)

( * ) Notice: Subject to any disclaimer, the term of this patent is extended or adjusted under 35 U.S.C. 154(b) by 0 days.

(21) Appl. No.: 18/554,439

(22) PCT Filed: Apr. 8, 2022

(86) PCT No.: PCT/IB2022/053321

§ 371 (c)(1),
(2) Date: Oct. 6, 2023

(87) PCT Pub. No.: WO2022/215047

PCT Pub. Date: Oct. 13, 2022

(65) Prior Publication Data

US 2024/0190602 A1 Jun. 13, 2024

(30) Foreign Application Priority Data

Apr. 8, 2021 (IT) ..... 102021000008750

(51) Int. Cl.

| | |
|---|---|
| ***B65B 57/14*** | (2006.01) |
| ***B65B 25/14*** | (2006.01) |
| ***B65B 35/40*** | (2006.01) |
| ***B65B 39/00*** | (2006.01) |
| ***B65B 59/00*** | (2006.01) |
| ***B65B 59/02*** | (2006.01) |

(52) U.S. Cl.

CPC ..... *B65B 57/14* (2013.01); *B65B 25/14* (2013.01); *B65B 35/405* (2013.01); *B65B 39/007* (2013.01); *B65B 59/001* (2019.05); *B65B 59/005* (2013.01); *B65B 59/02* (2013.01); *B65B 2210/04* (2013.01)

(58) Field of Classification Search

CPC ..... B65B 39/007; B65B 57/20; B65B 57/14; B65B 59/001; B65B 59/005; B65B 59/02; B65B 25/14; B65B 35/405; B65B 9/073; B65B 2220/08; B65B 2220/20; B65B 51/30; B65B 2009/063; B65B 2210/04

See application file for complete search history.

(56) References Cited

U.S. PATENT DOCUMENTS

| | | | | |
|---|---|---|---|---|
| 3,608,701 | A * | 9/1971 | Dieter | B65B 59/005 53/251 |
| 5,787,680 | A | 8/1998 | Tisma | |
| 7,752,828 | B2 | 7/2010 | Gudim et al. | |
| 2007/0137143 | A1 | 6/2007 | Dall'Omo | |
| 2015/0158611 | A1 * | 6/2015 | Kalany | B65G 47/26 53/531 |
| 2017/0320671 | A1 | 11/2017 | Rasi | |
| 2019/0359359 | A1 | 11/2019 | Scalerandi | |
| 2020/0071007 | A1 | 3/2020 | Frasnetti | |

* cited by examiner

*Primary Examiner* — Thomas M Wittenschlaeger
(74) *Attorney, Agent, or Firm* — Themis Law

(57) ABSTRACT

A packaging machine includes a compact dynamic shuttle buffer arranged upstream of a packaging station.

12 Claims, 10 Drawing Sheets

PACKAGING MACHINE WITH DYNAMIC BUFFER AND ITS ASSEMBLY METHOD

SCOPE OF THE INVENTION

The present invention relates to an improved and compact dynamic buffer machine for feeding a filling station e.g. a bundling machine.

The field of application of the invention is the industrial packaging field, whether applied to items not previously bundled, such as toilet or kitchen rolls, industrial rolls, medical sheets, or to items already bundled in order to obtain a multi-package, such as in the case of paper napkins and packs of paper rolls e.g. toilet paper, packs of nappies etc.

BACKGROUND ART

Setting up items for packaging, i.e., bundling items as above, involves several accumulation areas or buffers in front of the bundling bag inlet. Normally these buffers are large, and this leads to problems with both in transporting the machine and in configuring it within the plant where the machine is to be installed.

The US-A1-2015158611 describes a plurality of single-seated shuttles for loading items or groups of items. The presence and independent driving of many single-seated shuttles is complicated and costly.

The US-A1-2007137143 describes a walled conveyor belt configured to change pitch between walls. No mutually independent moving shuttles are described. A walled conveyor belt, although having a configurable pitch, has a relatively low level of flexibility of use and is suitable for a relatively low number of types (e.g. by size and/or weight, etc.) of items to be processed.

SUMMARY OF THE INVENTION

The present invention aims to solve the above-mentioned drawbacks of the background art by providing a compact dynamic buffer for managing the preparation of items before packaging and of easily changing the preparation modes to adapt to items and/or to different package sizes.

In particular, the improved dynamic buffer comprises at least two movable shuttles on a closed circuit, which considerably compacts the size of the machine.

A special feature of the invention is that it can also automatically change the pitch i.e. the longitudinal dimension of the individual seats defined by the shuttle to adapt to items having even very different dimensions.

Advantageously, there are sensors for measuring even along mutually orthogonal directions a parameter of the items group and, on the basis of this parameter, adapting the packaging filling station by means of suitable actuators so as to bundle the items group with a suitable tightening tension, i.e. not zero.

In an embodiment of the invention, there is provided a method for retrofitting a packaging machine, e.g. a bundling machine, by means of a dynamic shuttle buffer according to the invention.

BRIEF DESCRIPTION OF THE FIGURES

Further purposes, features and advantages of the present invention will be clear from the following detailed description of some preferred embodiments of the invention, provided by way of explanation only and not limitation by means of the appended figures, wherein.

DETAILED DESCRIPTION OF THE EMBODIMENTS

Figure 1:
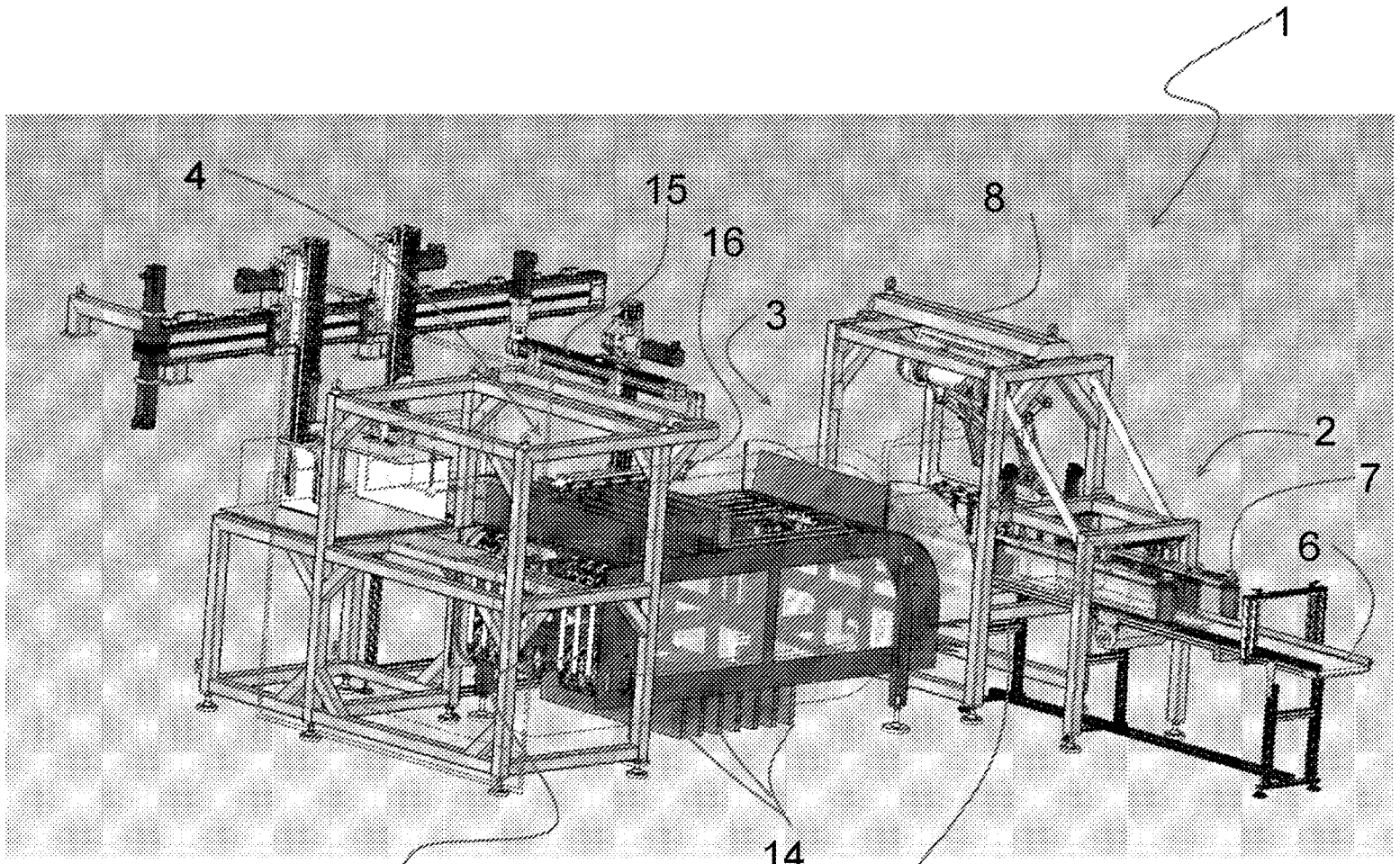
FIG. 1 is a perspective view of a machine according to the present invention (a packaging station of the machine is not illustrated)

With reference to the above figures, is indicated by 1 in as a whole an items processing assembly for a packaging machine (not illustrated in FIG. 1) comprising a feeding station 2 for receiving items from previous production steps and performing at least one set-up operation e.g. orientation and/or grouping, a shuttle grouping and transport (collating) station 3 for transporting ordered items from one or more of the packaging machines in an orderly manner items collected from the feeding station 2, a discharging station 4 for unloading ordered items from one or more shuttles, and a bundling or generally packaging station 5 (illustrated in FIG. 9) for handling the items ordered and unloaded from the discharging station 4 within a package, for example a bundling bag.

In greater detail, and according to a non-limiting embodiment, the feeding station comprises a conveyor belt 6 on which the items e.g. are loaded pell-mell or randomly, a launching device 7 e.g. with rollers for conveying with a predefined and constant frequency one or more items at a time into a loading area C facing the grouping station 3 and a loading device 8, e.g. a robotic diverter e.g. Cartesian or with at least 2 axes, for loading the items onto the shuttle. It is, however, possible that other devices are arranged to load singularised items or known quantities of items onto the shuttle, for example chain diverters with fixed pitch walls rotating intermittently or continuously. Preferably with a squared loop. The feeding station 2 can be configured to process in particular a column-like grouping of items oriented, for each column presented to the grouping station 3, all in the same way.

Figure 2:
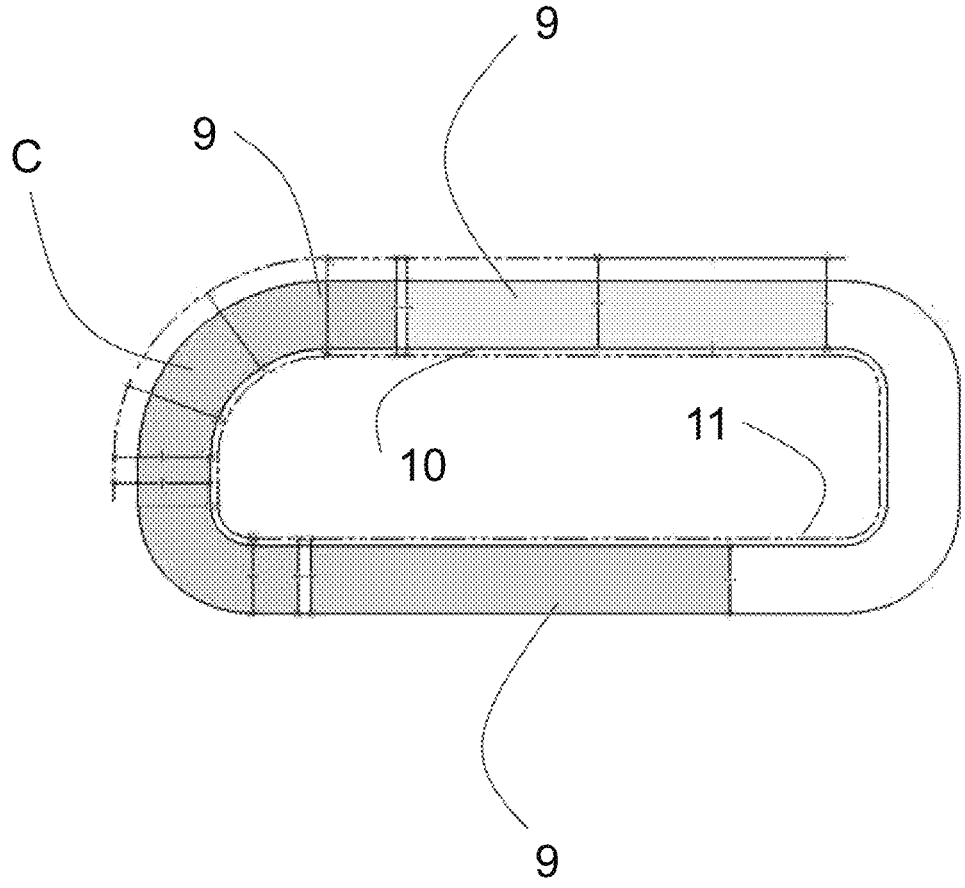
FIG. 2 is a schematic view of a shuttle circuit of the machine shown in FIG. 1.

FIG. 2 schematically shows a non-limiting embodiment of the shuttle grouping station 3 comprising a closed circuit along which two or more shuttles 9 are movable to load into the loading area C a plurality of items in corresponding predefined positions and bring them to the discharge station 4, and then return unloaded again to the loading area C. In the non-limiting embodiment form of FIG. 2, the closed circuit has an upper branch 10 defining the discharge station 4 and a lower branch 11. Towards the loading area C, the branches 10, 11 are connected with a radius of curvature greater than that applied by longitudinally opposite sides according to the direction of the branches themselves. In this way, it is easier to load the items onto the shuttle facing the loading area C. In particular, in the upper branch 10 the items are loaded on the corresponding shuttle 9 by gravity and in the lower branch 11 the shuttle 9 in transit is turned upside down and therefore unloaded. Therefore, the lower branch 11 is a return branch for the shuttles 9 for the purpose of performing continuous cycles of loading-unloading operations. The circuit of FIG. 2 allows loading items perpendicularly to a bottom of the shuttles 9 and so, during the path to the discharge station 4, the items rotate by 90°. Alternatively, the feeding station 2 can be configured to load the items laterally on the shuttles 9 i.e. along the same direction of unloading at the discharge station 4. In such a case, the items are loaded onto the shuttles 9 in the same angular orientation in which they are subsequently unloaded.

Figure 3:
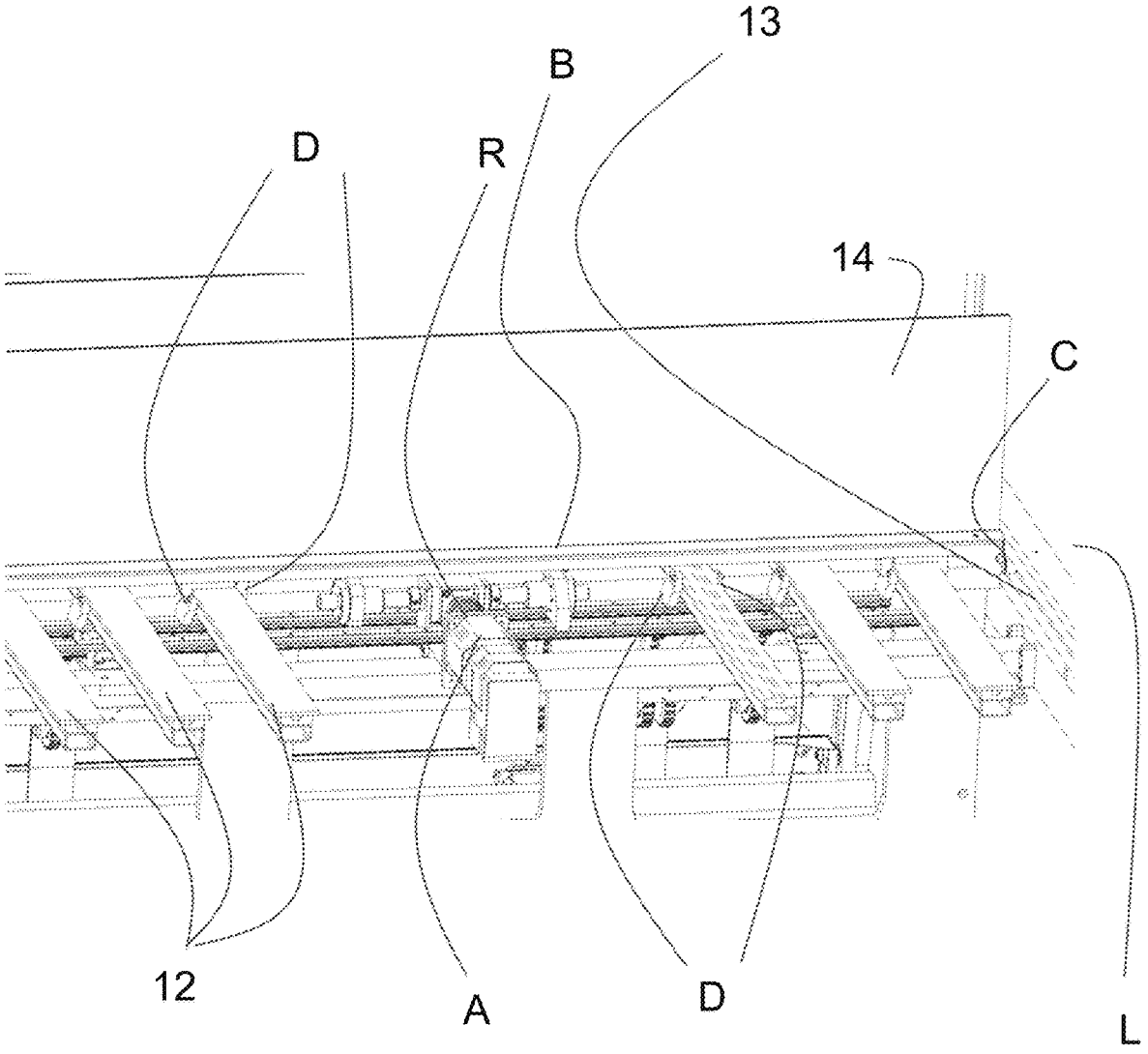
FIG. 3 is a perspective detailed view of a shuttle conveyor from the machine in FIG. 1.

With reference to FIG. 3, the grouping station 3 comprises, for each shuttle 9, a motor-driven belt, chain or other flexible endless element 12 rolley. Each shuttle 9 is therefore independently controllable from the others, e.g. during the transport of items, so as to allow the replenishment of a shuttle 9 at the loading area C and the unloading of another shuttle 9 at the discharge station 4. Preferably, in order to independently control the movement of the shuttles 9, the belts 12 are side-by-side and each shuttle 9 is guided by means of suitable rails 13 following the closed circuit. For example, the rails 13 are loaded by the weight of the shuttle 9 with the items on board when the shuttle itself reaches the discharge station 4.

In order to define a seat for each items or each group of items, each shuttle 9 comprises a plurality of walls 14 (FIG. 1) transverse to the direction of transport along the circuit and spaced apart from each other, preferably equally spaced along the transport direction. The walls 14 longitudinally delimit a plurality of seats for transporting items on the corresponding shuttle 9. As indicated above, the belts 12 are side by side transversely to follow, each, the circuit and preferably each shuttle 9 is guided by a pair of belts 12. The walls 14 of each shuttle are connected to the corresponding pair of belts 12 and preferably the walls 14 of all the shuttles 9 have the same length e.g. they are all at least as long as the transverse distance between the two most distant belts 12 from each other.

According to a first embodiment, each shuttle 9 comprises a plurality of wheeled trolleys C resting on the rails 13 and each trolley is attached to a corresponding pair of belts 12 to move along the rails 13. According to this embodiment, each shuttle comprises a plurality of trolleys each carrying a wall 14. Alternatively or in combination, each wall 14 has a cross-section in the shape of an inverted 'L' or 'T' or similar with one or two bases B, the latter being the support for the items. According to the embodiment illustrated in the figures, the bases B have a limited depth with respect to the width of the walls 14, this is in particular adopted when the items processed are rigid and/or of box or square shape and therefore can be supported at opposing edges.

Figure 4:
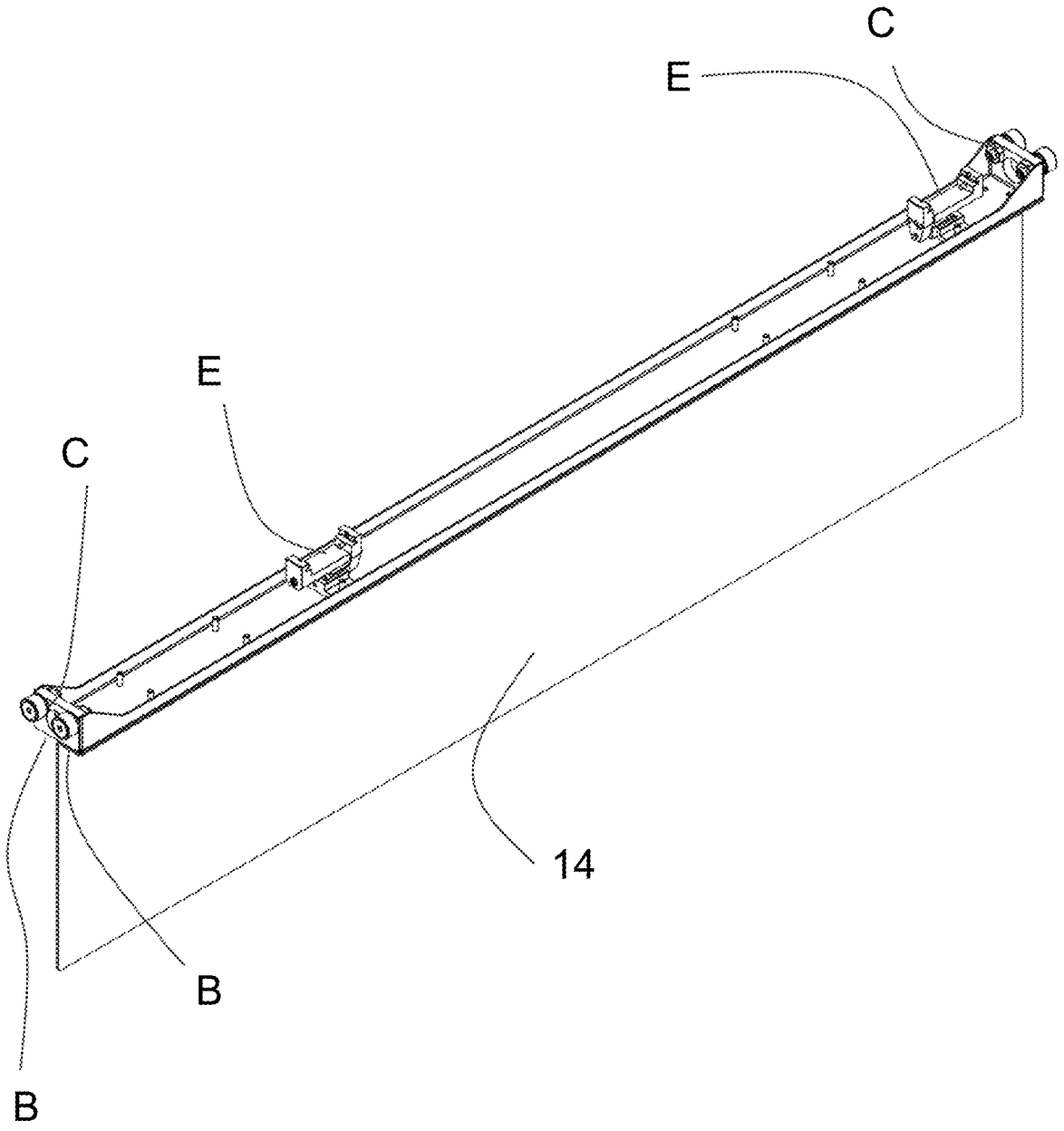
FIG. 4 is a perspective view of an upside-down component of a shuttle.
Figure 5:
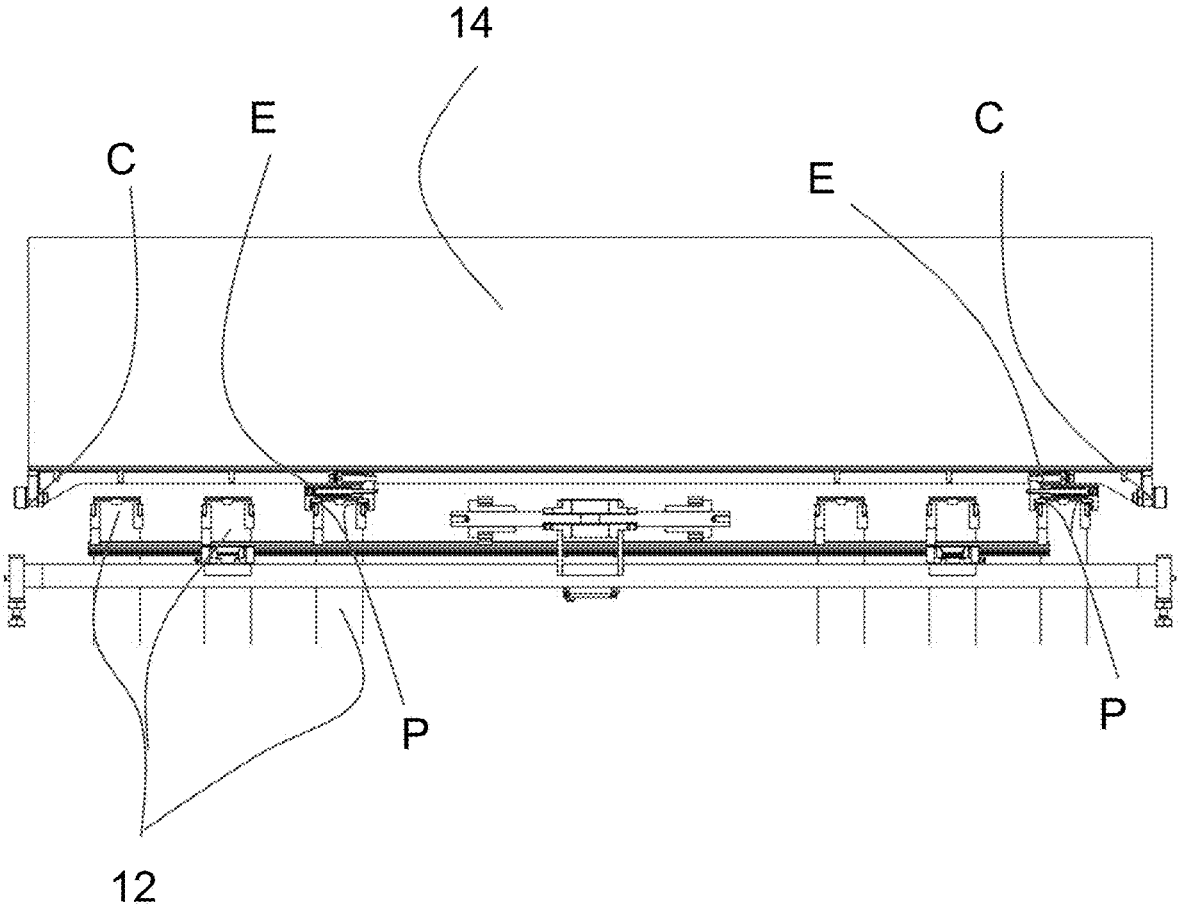
FIG. 5 is a front view of a shuttle.

A pitch between the walls 14 is constant while the shuttle is loaded with items and is moving between the stop load section and the stop unload section and advantageously walls 14 are releasably connected to change the pitch and/or overall length of the shuttles 9 but it is also possible, according to an embodiment not shown, that the shuttles 9 have a predefined, non-adjustable length. Changing the pitch preserves and does not change the number of locations for loading items. For example, each wall with one or two bases B is connected to corresponding shuttles 9 so that the distance between them can be varied and, in this way, adapt to various items or types of packages to be handled. For example (FIG. 4), each wall 14 has a pair of trolleys C arranged on corresponding transverse ends to engage in the rails 13 and coupling elements E for coupling with belts 12. In this way, rails 13 are loaded by the weight of the shuttle both along upper branch 10 and along lower branch 11 and belts 12 are loaded substantially by traction. According to an embodiment, shuttle circuit 9 comprises a longitudinal pitch changing station 14 and, consequently, coupling elements 5 are releasable. For example, belts 12 are toothed and coupling elements E are fixed to the corresponding belt 12 by means of a spring-movable pin P (or two opposing pins as in the figure) which, in an engaged position, is transversely interposed between two adjacent teeth of the belt 12 and is maintained in the engaged position by means of a spring. When shuttles 9 are arranged for the variation of the pitch between the walls 14, bases B of reduced depth, e.g. not exceeding 5 cm, is particularly useful: the bases B support the opposing edges of the items for various pitches of the walls 14.

According to a preferred embodiment, the grouping station 3 is electronically controlled to automatically perform the variation of the pitch of the walls 14 as follows:

- Aligning the trolley with the movement path of a release actuator, e.g. a linear actuator A moving in a transverse direction, preferably perpendicular, to the direction of belt supply 12
- Stopping the belts 12 in this alignment position and the actuator is moved to actuate spreaders D to disengage the carriage from the belt 12, e.g. the spreaders D come into contact with the sidewalls of the element E and spread them apart, thereby retracting the pin from the belt 12 against the action of the corresponding spring. For example, the actuator A is a rotary motor with a gearbox R for the rotation of a shaft on which are mounted 6 pairs of spreaders D, one for each belt 12 and corresponding element E. When the shaft turns in one direction, the spreader(s) D open e.g. simultaneously and when the shaft turns in the opposite direction, the spreader(s) D close and the element(s) E close on the corresponding belt(s) 12 due to the action of its own spring;
- Moving the belts 12 by a predefined amount and then stop in a new position relative to the release actuator, this position establishing the new pitch between the walls 14;
- Driving the release actuator to re-engage the form-fit coupling to the corresponding belt 12 e.g. the actuator is released and the pin returns to a new pair of teeth due to spring action Preferably, the wall 14 is supported in a fixed position while the belts 12 are moved to obtain the new pitch. However, it is possible to operate differently, e.g. the belts 12 remain stationary and the wall 14 is moved by means of suitable actuators. Or both the belts and the walls are movable to reach the new position that defines the new pitch of the walls 14.

For example, in order to precisely control the position of the belts 12 during the automatic pitch variation operation of the walls 14, the grouping station 3 includes rotary electric motors (not shown) equipped with angular encoders to count the number of revolutions and measure portions of a revolution.

Figure 6:
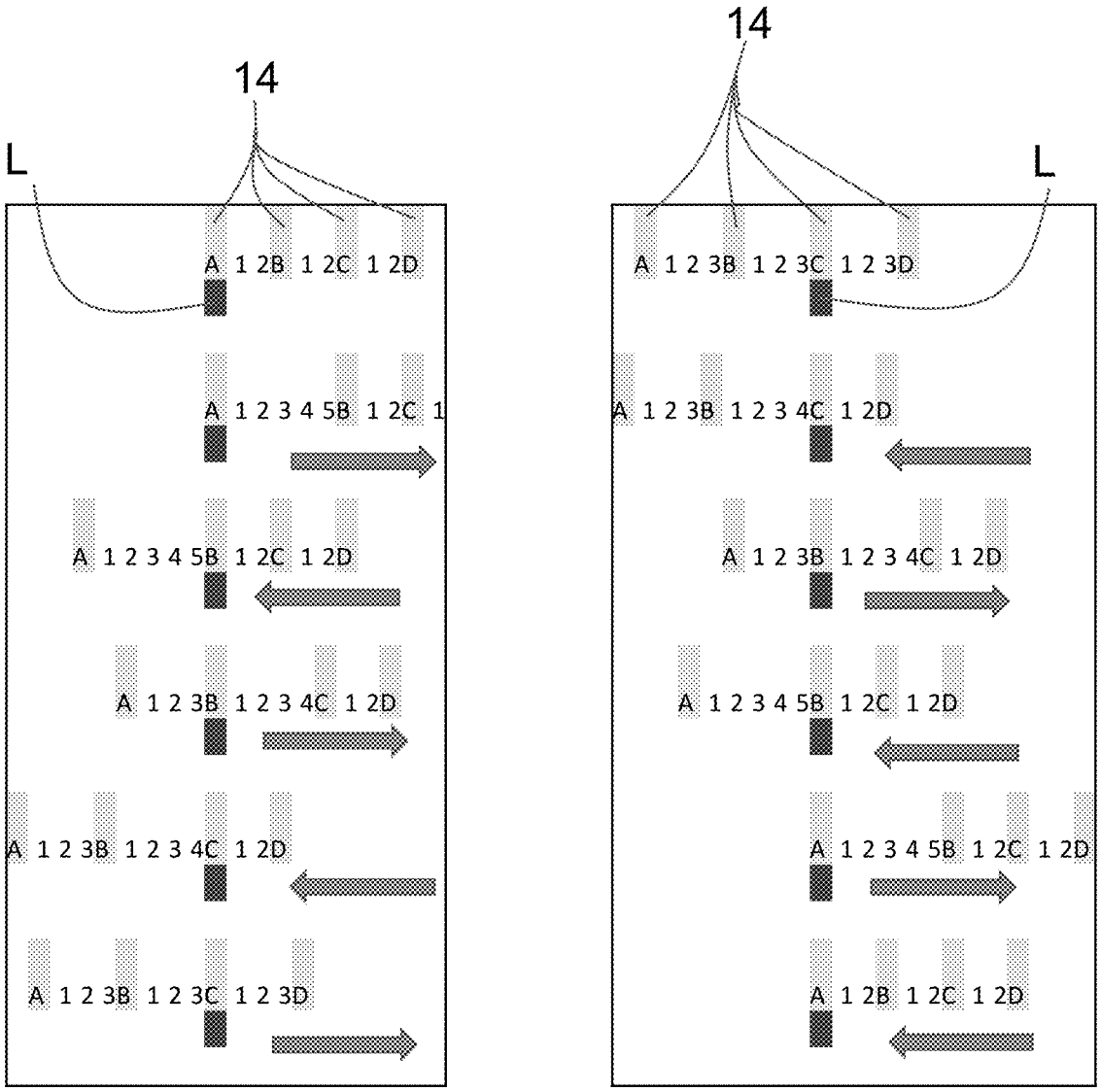
FIG. 6 illustrates a first and second scheme for changing the pitch of a shuttle.

The step change sequence is performed in two alternatives: one for increasing the pitch (e.g. by disengaging the first wall 14 of the shuttle 9 and moving away from the following walls, translating the shuttle onto the second wall 14 and repeating) and another for reducing the pitch (e.g. by disengaging the second wall 14 and moving the following walls closer, translating the shuttle onto the second wall and repeating). In FIG. 6 is schematically shown (left) a sequence of operations for increasing the pitch between the walls 14 following the actuation of the actuator arranged at a position L along the circuit; and a sequence of operations (right) for reducing the pitch between the walls 14.

Both sequences involve working on the walls of each shuttle 9 and on all shuttles.

When a loaded shuttle 9 reaches the discharge station 4, the items are unloaded in a predefined number corresponding either to the exact number of items to be packed in the packaging station 5 or to an integer multiple. This can be performed in various ways and, according to FIG. 1, the discharge station 4 comprises a linear actuator 15 and a multi-head tool 16 moved by the linear actuator 15. The latter is arranged so that the movement of the tool 16 is parallel to the walls 14 and that, preferably, each head moves in the corresponding seat of the loaded shuttle 9 so as to laterally unload the items from the shuttle. For example, a thickness of the walls 14 does not exceed 5 millimetres. It should be noted that the shuttles 9 may be loaded from the feeding station with columns of items in integer multiples of the items to be packaged via the packaging station 5. In such a case, the tool 16 is operated in such a way as to unload from the shuttles 9 the items in the exact packaging configuration. Therefore, it may happen that the shuttle(s) 9 stop at the discharge station 4 with seats only partially occupied by the items e.g. in the case where the tool 16 has unloaded only a part of the items loaded on the shuttle and is waiting for the process of these items to unload others while the shuttle(s) are stopped at the discharge station 4.

Figure 7:
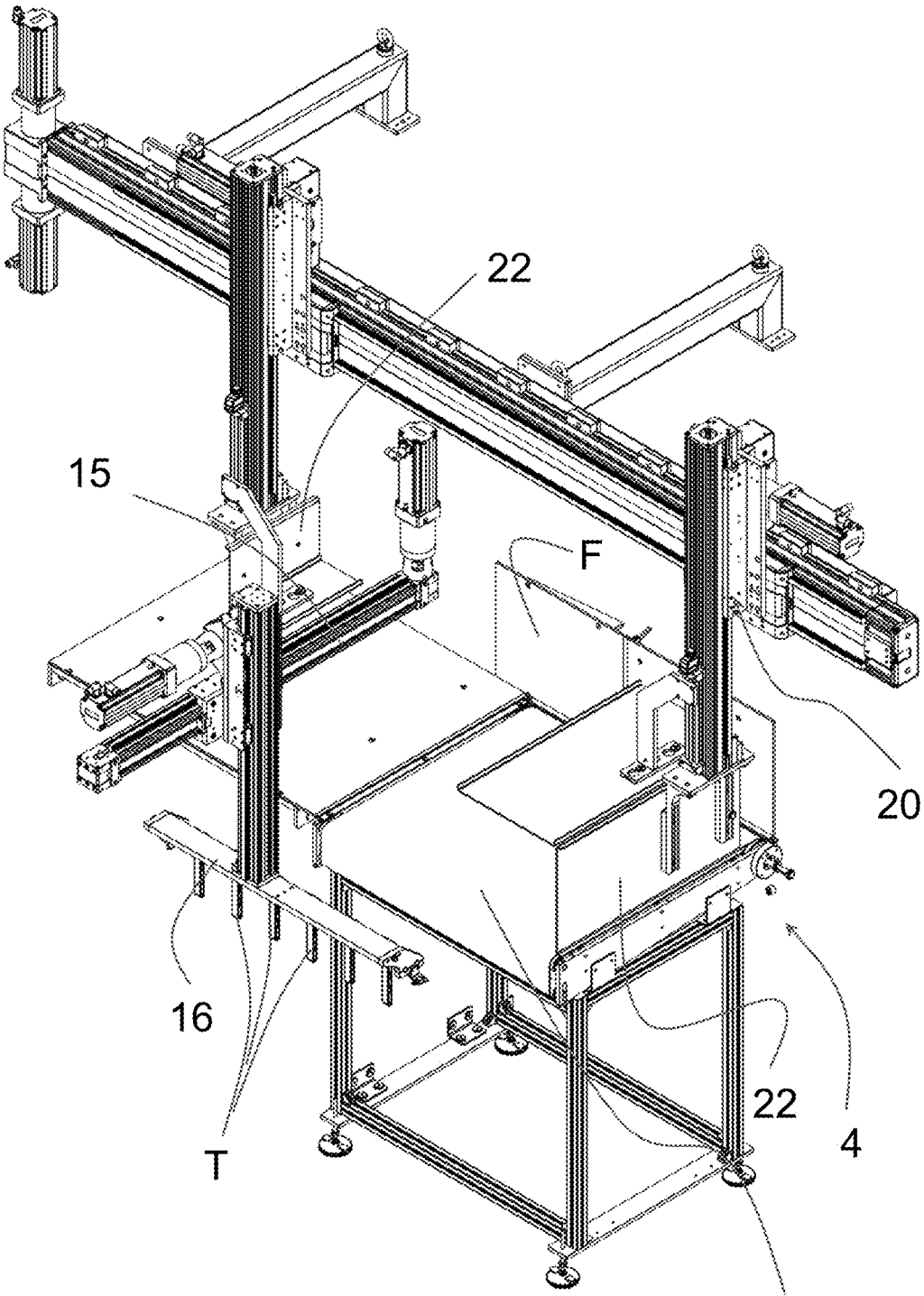
FIG. 7 is a perspective view of a subassembly of the machine in FIG. 1.
Figure 8:
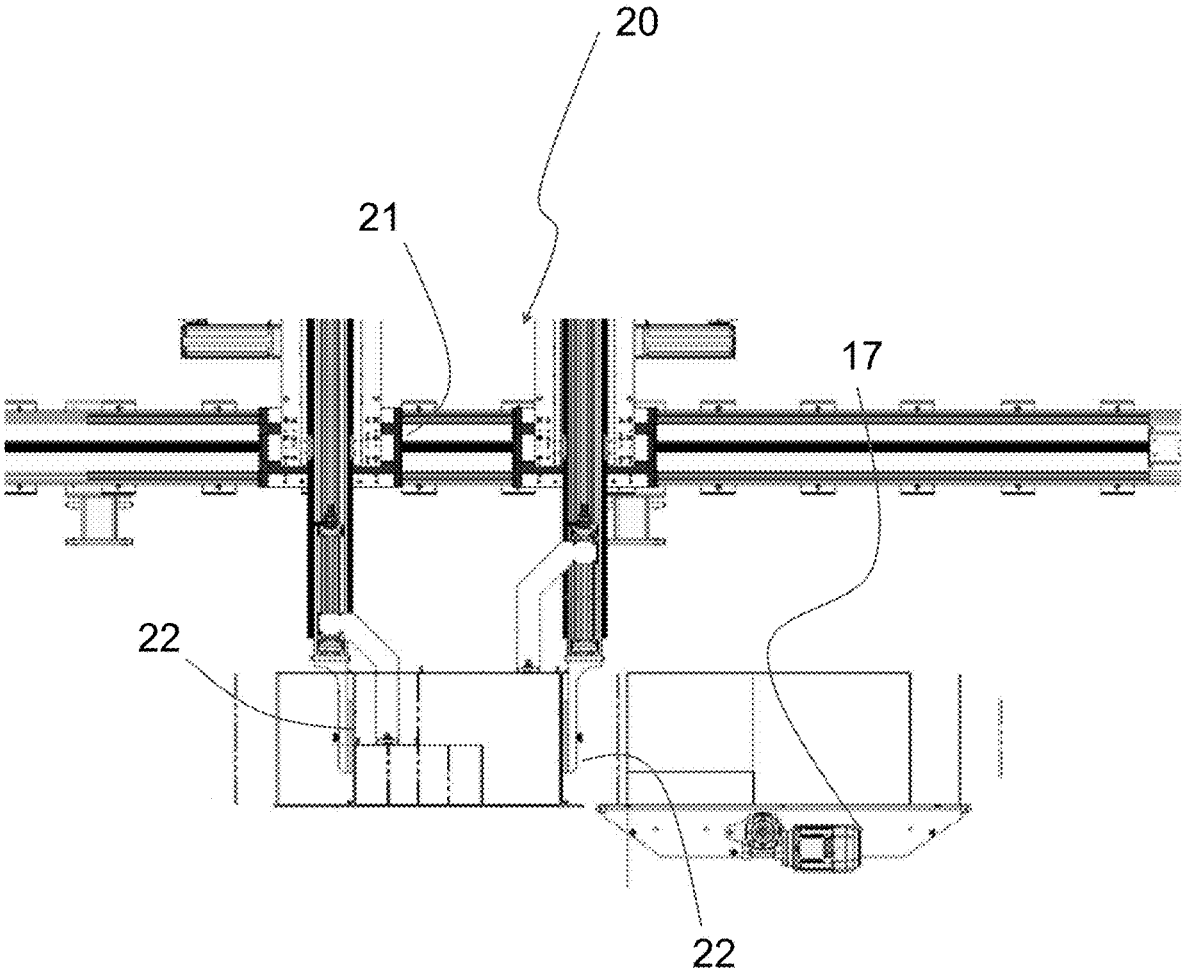
FIG. 8 is a front view of FIG. 7.

The discharge station 4 further comprises an unloading platform 17 (FIG. 7) on which the items unloaded from the shuttle 9 via the tool 16 are deposited, e.g. translated. Advantageously, the unloading platform 17 for pushing the items against a fixed wall For is movable in a vertical direction so as to stack the items in the case of packages with stacked items or in several rows. Alternatively, the movable unloading platform 17 may act as a buffer to perform subsequent bundling of the items according to the configuration and number of items as unloaded from the shuttle 9.

In use, at least the following operational cases may occur:

number of items M in a row of the pack prepared in station 5 equal to a submultiple of the N locations on shuttle 9. In this case there will be a series of extractions of items from the shuttle that will be sufficient to complete a finite number of bundles (e.g. bundles of 3 or 2 in a row and shuttle with 6 seats, as in the figures);

number M of items in the bundle smaller than the number N of locations in shuttle 9 but not submultiple (e.g. packs of 4 or 5). In this case, from the shuttle 9 a series of extractions of items in a number sufficient to complete a finite number of bundles is carried out. At least one article remains on the shuttle and to empty the shuttle in order to send it to receive a new load, a new loaded shuttle must be come side by side;

number M of items in the pack greater than the number N of shuttle locations (in the case of 7 or 8 packs, for example). In this case an extraction of items is carried out simultaneously from two shuttles side by side.

Each of these cases is characterised by its own sequence of movements that allows the cycle to be replicated after a determined number of steps characteristic of the situation. In particular, on the basis of the longitudinal dimension of each seat selected as input data on the basis of the article to be processed, and of the number of items in the packaging station 5, which also defines the geometry of the tool 16 e.g. the heads T are connected in a sliding manner to the crossbar so as to be able to adapt to the various steps of the walls 14, the shuttle(s) 9, before heading empty for a new load, are translated by a path having a length corresponding to the M items to be unloaded by means of the tool 16. In particular, this length is equal to the pitch of the N seats multiplied by M in the case where one and only one item is loaded in each seat. By means of a control, for example, based on the ratio between M and N and the number of shuttles 9 operated on the circuit, it is possible to calculate:

When a shuttle 9 is partially unloaded and it needs to be moved to unload it completely How many items are on board each shuttle 9 stopped in front of the platform 17 just before the implement is operated 16

When shuttle 9 is empty and heading for loading area C

It is also possible to manage the synchronisation of movement between the loading device 8, the shuttles 9 and the tool 16 by setting appropriate predefined time intervals for action, possibly integrated with sensors that check for abnormal error conditions, for example by monitoring the torque e.g. the current absorbed by the loading device 8 that is unable to load on the shuttle 9 because the items is crooked; or by means of a photocell to detect if there is an obstacle in a trajectory that should be free.

Therefore, it is advantageous that the shuttles 9 and/or a shuttle position control system along the circuit are configured to achieve, if necessary, a configuration in which at least two shuttles are adjacent to each other (one loaded and the other loaded or partially loaded) and there are no significant pitch variations between the last seat of one shuttle and the first seat of the adjacent shuttle. In this way, when the tool 16 pulls the items onto the platform 17, the unloaded items are substantially arranged in a row and in the exact number to be bundled at the station 5. This is achieved, for example, by arranging the first and last walls 14 of each shuttle either flush or projecting so that, in the position of adjacent shuttles, the walls 14 are in contact or spaced a few millimetres apart, for example. Furthermore, the walls 14 themselves have a relatively small thickness, e.g. no more than 3 millimetres, so that the double thickness resulting from the flanking of two shuttles in the contact area is negligible with respect to the design clearances of the pitch between the seats and the size of the items to be processed.

FIG. 6 shows a measuring device 20 arranged between the grouping device 3 and the packaging station 5. The measuring device 20 comprises a sensor for measuring a parameter representative of a dimension of the set of items to be packaged, e.g. bundled, so that an electronic control unit for controlling the packaging station 5 can adapt the opening of the package, e.g., by means of suitable actuators the so-called 'bundle bag' made from a tubular of one or more layers of polymeric material thermally welded after bundling, so as to avoid interference during bundling, in case the size of the items exceeds a first pre-defined threshold and based on the bundling opening of the bundle bag, or to have a slack package in case the detected size is below a second pre-defined threshold also based on the bagging opening. For example, the adaptation of the bundle bag opening by the actuators is, in the case of a detection exceeding the first threshold so as to indicate a bundle bag that is too small, to widen the bundle bag opening so as to avoid interference during bagging. If, on the other hand, the detection does not reach a second threshold so as to indicate a bundle bag that is too large, the bundle bag is tensioned so as to reduce the size of the package. In an embodiment, the detection is performed on a grouping of items to be packed, i.e. a bundle, and the adjustment of the pack via the control unit is carried out before the bundling of the detected grouping. In general, a tendency of the items to enlarge/decrease their size in the ordered pre-bundling configuration of the bundle e.g. due to environmental causes such as humidity level can also be detected, and thus the filling station 5 will also adapt the package with a time delay or phase shift with respect to the detected bundle.

According to the embodiment illustrated in the figures, the sensor comprises a conveyor 21 to move the group of items unloaded from the shuttle to the front of the bagging opening: the time spent in the transport is used to perform the adaptation of the bagging opening.

In addition, the sensor comprises a pair of paddles 22, possibly shaped to adapt to the conformation of the grouping of items, moved by actuators to compress the grouping of items arranged on the platform 17 in the same direction of operation as the actuators of the station 5 to adjust the size of the bundle bag opening.

In particular, the paddles 22 are controlled by the electronic control unit to press on the grouping by reaching a pre-defined relative distance and the pressure or resistance that is applied by the grouping of items on the paddles upon reaching the pre-defined relative distance is indicative of the actual size, e.g. width, of the grouping of items, a parameter representative of the energy supply to the actuators of the paddles 22 required to reach the pre-defined relative distance is measured. For example, the actuators are electrically driven and the supply current is measured and the control unit compares the measured current with a stored reference table containing data to relate the measured current to the size of the grouping of items being bagged. Advantageously, according to the same principle as indicated above for the paddles 22, the wall F is also instrumented to detect a force applied by the items P when pushed into the stop via the multi-head tool 16 at a predefined distance from the wall F. In this way it is possible to measure the group of items before bagging in two directions at right angles to each other.

Figure 9:
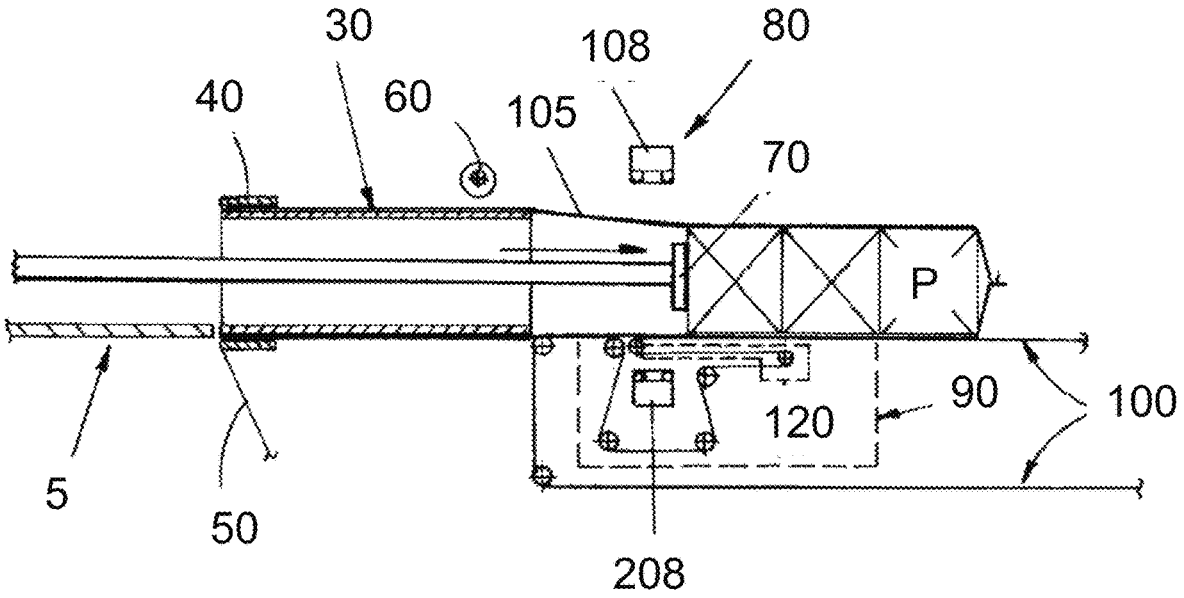
FIG. 9 is a schematic side view of a packaging station of the machine in FIG. 1.

FIG. 9 shows an example embodiment of packaging station 5 comprising a system for adjusting the bundle bag size on the basis of sensors 21. In particular, the station 5 comprises: a hollow mandrel 30 having a folding shoulder 40 and defining a filling window; a sealing device 60 for forming a seal (not shown) of the longitudinal edges of the film 50; a horizontally movable pusher 70 for pushing a group of items P into the mandrel 30; a sealing and transverse cutting assembly 80 comprising two vertically movable elements 108, 208 mounted on a horizontally movable primary carriage 90; a conveyor 100; a secondary carriage 120 carried by the primary carriage 90. In use, station 5 functions as follows:

Reduce the cross-sectional area of the mandrel 30 to a cross-section smaller than that of item group P by known methods Place the sealing device 60 in a position to seal the overlapping longitudinal edges of the film 50 while forming a new tubular bundle bag;

Arrange the elements 108, 208 in a closed position on the head part of the new tubular film wrapper and on the end part of the tubular film wrapper of a finished package;

transporting said new tubular casing, by movement of the primary shuttle 9 away from the mandrel 30, and repeating the preceding steps so that the items placed inside the tubular casing by the mandrel 30 are tightly and adhesively wound due to elastic shrinkage of the film of the tubular casing.

In particular, when the sealing and cutting assembly 80 is in the end position away from the mandrel, the longitudinal sealing device 60 is transversely enlarged, the elements 108, 208 are opened and the mandrel 30 is transversely enlarged, appropriately enlarging the portion of the tubular casing disposed outside the mandrel itself and the assembly of items P is slightly compressed to allow the assembly to enter the inside of the mandrel. In addition, prior to the step of closing the elements 108, 208 that tighten the tubular film wrapper, the mandrel 30 is reduced transversely and the pusher 70 begins to move backwards so that a new packaging cycle can be started.

Figure 10:
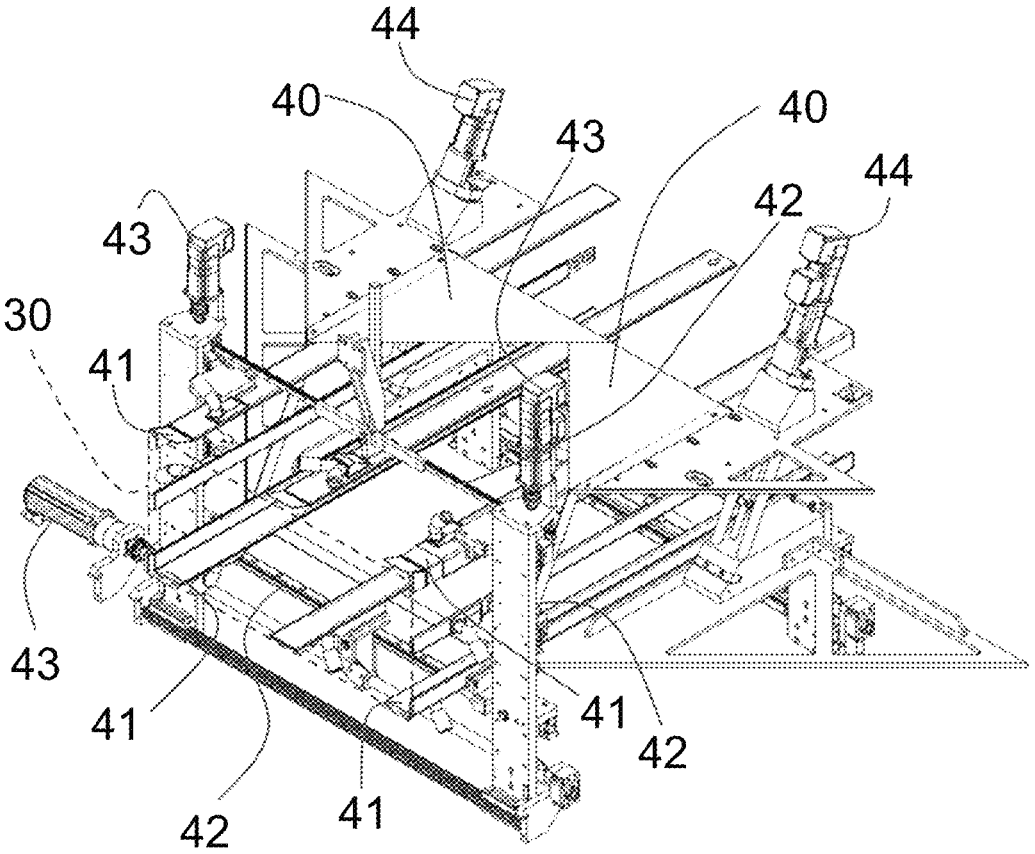
FIG. 10 is a perspective view of a module of the packaging station in FIG. 9.

FIG. 10 illustrates a known example embodiment of a mandrel 30 provided with actuators with reference to a packaging machine employing a polymeric film e.g. a bagging machine. In particular, the mandrel 30 includes four angular brackets 41 aligned to define a bagging window within which the pusher 70 moves the bundle. The brackets 41 extend longitudinally in a direction parallel to the direction of movement of the pusher and are peripherally wrapped by the polymeric film, which conforms according to the cross section of the mandrel 30. The brackets 41 are mounted on movable supports along guides 42 preferably perpendicular to each other and, by means of actuators 43, are movable to change the format e.g. when the composition of the bundle or the article to be packaged changes and/or to receive a signal via the sensor 20 and adjust their position even by a few millimetres so as to adapt to the detected size of the bundle. FIG. 10 further illustrates folding shoulders 40 which are partially overlapping to guide the tubular conformation of the bundle bag from a polymeric film. The shoulders 40 are movable by means of actuators 44 preferably dedicated to and coordinated with the actuators 43 so that the film surrounds the brackets 41 with the correct tension following a controlled change in the cross section of the mandrel 30. The shoulders 40 are partially overlapping in order to bring two flaps of the film on top of each other and to allow sealing by means of the sealing device 60. It is clear that further and numerous variations are possible for a skilled man; just as it is clear that in its practical implementation the shapes of the illustrated details may be different and the same may be replaced with technically equivalent elements.

For example, the bagging station may more generally be any packaging station in which it is possible to adapt the packaging within predefined limits to the geometric parameter detected by the energy sensors of the paddle actuators 22.

Furthermore, by means of appropriate calculations, it is possible for the shuttles to have an equal number of locations, as in the figures, or each have their own number of locations N1, N2 etc.

For example, the multi-head tool 16 is configured to also discharge sideways from opposite side to the platform 17, e.g. to a palletiser (not shown). The implement may also be mounted not on a linear actuator but on a motorised belt device to follow a circuit. Such a device is mounted above the shuttles and the multi-headed tool performs its own unloading stroke in a lower branch of the circuit.

According to an embodiment, the feeding station 2 is configured and programmed to load onto the shuttles 9 an entire multiple of the bundle or bundle to be packed at the station 5. In such a case, the multi-head tool 16 is programmable to partially unload in the lateral direction the items on the platform and define a bundle to be packed. For example, the bundle may be processed e.g. by the paddles 22 while the shuttle(s) 9 are stationary at the unloading station 4 and, after the platform 17 has been cleared, the tool 16 unloads a new bundle onto the platform 17. According to another embodiment, the platform 17 is movable in a vertical direction and the bundles are stacked vertically when they are unloaded by the shuttle(s) 9. While the bundles are unloaded but the shuttle(s) 9 are still partially loaded considering the lateral direction, the shuttle(s) remain stationary at the unloading station 4 until they are completely unloaded.

The invention claimed is:

1. A packaging machine for items, comprising:

a packaging station (5) having a support device (40, 41) configured to define a filling window, in use bounded by a package held in an open configuration by the support device;

a conveyor (12) having a first and a second shuttle (9) independently movable with respect to each other along a corresponding closed circuit having a stop and discharge section, each of the first and the second shuttle comprising a first and respectively a second plurality of seats defined by walls (14) for receiving the items intended to enter the package through the filling window;

an automatic loading device (2) configured to load the items onto said first or said second shuttle in a stopping and loading section of said circuit, the items being arranged in said plurality of seats;

an automatic unloading device (16) configured to unload the items from the first and/or the second shuttle arranged in a stopping and unloading section by a movement parallel to a first direction; and a control unit programmed to:

receive an incoming M number of the items in the package, wherein a number N1 represents a maximum number of the items that can be carried on board the first shuttle and arranged in the first plurality of seats, and wherein a number N2 represents a maximum number of the items that can be carried on board the second shuttle and arranged in the second plurality of seats, and when M is different from N1 and/or N2:

hold the first shuttle in the stopping and unloading area, position the second shuttle alongside the first shuttle in the stopping and unloading area, and unload, by the automatic unloading device, M items of which some are on the first shuttle and others are on the second shuttle to fill the package.

2. The packaging machine according to claim 1, wherein the first and the second shuttles are configured such that, for each shuttle, a pitch between the walls (14) is constant while the first or the second shuttle is loaded with the items and is moving between the stopping and loading section and the stopping and unloading section.

3. The packaging machine according to claim 2, wherein at least one of the first or the second shuttles comprises one or more of the walls (14) that are movable and further comprises a coupling device (E) for adjusting a longitudinal position of the walls that are movable on the corresponding first or second shuttle (9).

4. The packaging machine according to claim 3, wherein the coupling device (E) comprises at least one pin movable between a position withdrawn from a seat in which a corresponding wall is releasable and a position advanced into a corresponding seat in which the corresponding wall (14) is engaged with the conveyor (12) and further comprises an actuator (A) arranged along the circuit to guide the pin into the withdrawn position.

5. The packaging machine according to claim 3, wherein the control unit is programmed to receive as input a data representing a new distance between the walls (14) and to move the corresponding shuttle (9) by a distance equal to a distance variation between the walls to obtain said new distance.

6. The packaging machine according to claim 1, wherein the first and second shuttles carry the corresponding first and second plurality of the seats for the items and are configured such that M adjacent seats of the first and the second plurality of seats are intercepted by said automatic unloading device when the first and the second shuttles are positioned in the stopping and unloading section.

7. The packaging machine according to claim 1, further comprising a shifter or roto-translator (22) configured to move the M items unloaded from the first and the second shuttles in front of said filling window and having gripper blades and sensors configured to measure a parameter representative of a dimension of the M items grouped as a bundle prior to entry into said filling window.

8. The packaging machine according to claim 7, wherein the control unit is programmed to operate actuators (43, 44) configured to adapt the package based on said parameter.

9. The packaging machine according to claim 8, further comprising an unloading platform (17) interposed between the stopping and unloading section and the packaging station (5) and comprising a support surface defined by a conveyor belt for the items.

10. The packaging machine according to claim 1, wherein the support device (40, 41) is configured such that:

the items enter the package through the filling window with a movement in the first direction;

the package is made of a sealable polymeric film;

the stopping and unload station is transverse to the first direction;

the closed circuit comprises an upper branch (10) defining the stopping and unloading station and a lower branch (11) extending upside down by the first and second shuttles (9); and the unloading device (16) comprises a structure movable in the first direction and intercepting said plurality of seats to unload the items.

11. A method for setting up a packaging machine comprising the step of:

mounting upstream of a packaging station (5) having a support device (40, 41) configured to define a filling window, in use bounded by a package retained in an open configuration by the support device;

a conveyor (12) having at least a first and a second shuttle (9) independently movable with respect to each other along a corresponding closed circuit having a stop and discharge section, each of the first and the second shuttles comprising a plurality of seats defined by walls (14) for receiving items intended to enter the package through the filling window;

an automatic loading device (2) configured to load the items onto said first or said second shuttle in a stopping and loading section of said closed circuit, the items being arranged in said plurality of seats;

an automatic unloading device (16) configured to unload the items from the first and/or the second shuttle arranged in a stopping and unloading section by a movement parallel to a first direction; and providing a control unit programmed to:

receive an incoming M number of the items in the package, wherein a number N1 represents a maximum number of the items that can be carried on board the first shuttle and arranged in the first plurality of seats, and wherein a number N2 represents a maximum number of the items that can be carried on board the second shuttle and arranged in the second plurality of seats, and when M is different from N1 and/or N2:

hold the first shuttle in the stopping and unloading area, position the second shuttle alongside the first shuttle in the stopping and unloading area, and unload via the automatic unloading device M items of which some are on the first shuttle and others are on the second shuttle to fill the package.

12. The method according to claim 11, wherein the first and the second shuttles are configured such that, for each shuttle, a pitch between the walls (14) is constant while the shuttle is loaded with the items and is moving between the stopping and loading and the stopping and unloading sections.

* * * * *